United States Patent [19]

Bender et al.

[11] 4,376,928

[45] Mar. 15, 1983

[54] ADJUSTABLE TEMPERATURE SENSOR

[76] Inventors: H. Nelson Bender, 314B Mink Rd., Perkasie, Pa. 18944; Frank Bender, 421 E. Rockhill Rd., Perkiomenville, Pa. 18074

[21] Appl. No.: 288,870

[22] Filed: Jul. 31, 1981

[51] Int. Cl.[3] ..... H01H 37/36

[52] U.S. Cl. ..... 337/323; 337/331

[58] Field of Search ..... 337/309, 312, 314, 323, 337/327, 329, 330, 331

[56] References Cited

U.S. PATENT DOCUMENTS

| | | | |
|---|---|---|---|
| 1,638,814 | 8/1927 | Epstein | 73/750 |
| 2,721,317 | 10/1955 | O'Neill | 340/678 |
| 3,230,333 | 1/1966 | Berman | 335/52 |
| 3,267,230 | 8/1966 | Schonfeld | 200/81.6 |
| 3,313,947 | 4/1967 | Bisson | 337/331 |
| 3,582,590 | 6/1971 | Eubank | 200/152 X |
| 3,815,816 | 6/1974 | Scavelli | 337/331 |

*Primary Examiner*—George Harris

*Attorney, Agent, or Firm*—Seidel, Gonda, Goldhammer & Panitch

[57] ABSTRACT

An adjustable temperature sensor control device wherein mercury in a well is displaced upwards in a capillary with one electrical contact within the well and another electrical contact positioned within the capillary. The displacement of the mercury is accomplished by rotating a knob which is screw thread connected to a stem. The stem moves within the well to displace mercury through the capillary.

7 Claims, 4 Drawing Figures

FIG. 1
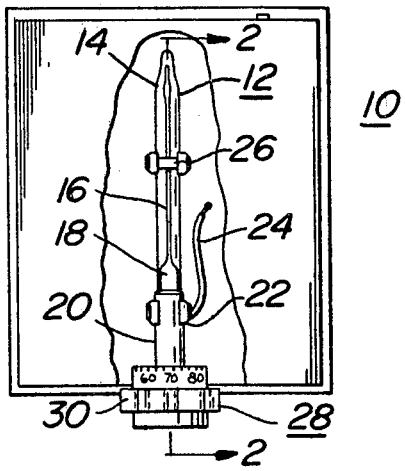
FIG. 2
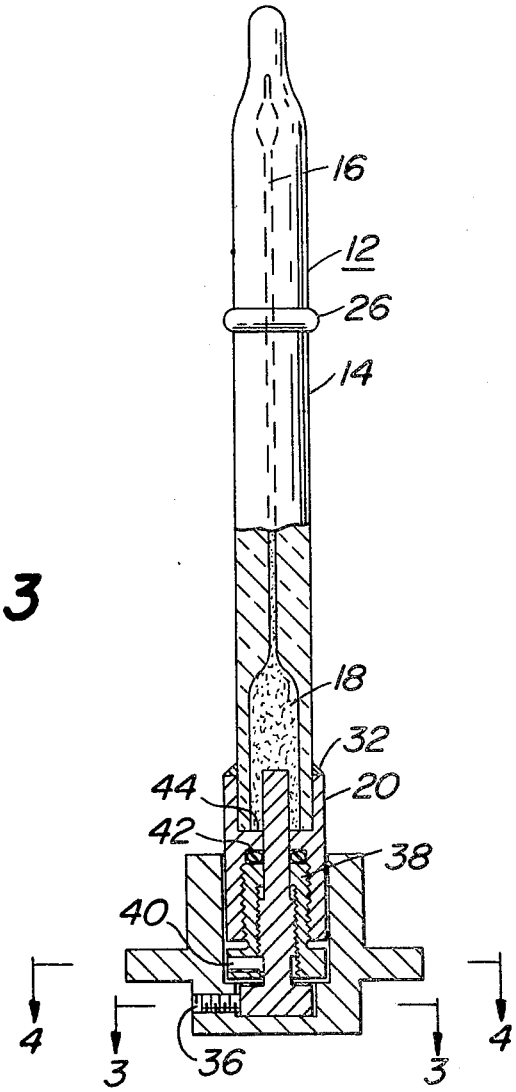
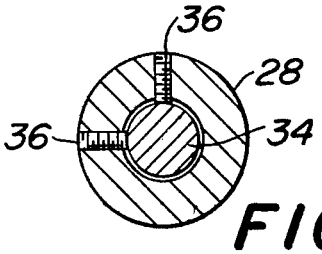
FIG. 3
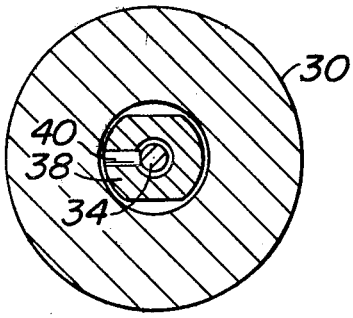
FIG. 4

ADJUSTABLE TEMPERATURE SENSOR

BACKGROUND OF THE INVENTION

This invention relates to an adjustable temperature sensor. More particularly, the present invention concerns an improved mercury temperature sensing device that allows for adjustability of the desired temperature setting which will initiate operation of the sensor.

The control of temperature in both residential and commercial structures have recently received a great deal of interest in light of the present world energy crisis. The national interest in conserving our dwindling hydrocarbon fuel supplies coupled with soaring energy costs have focused much attention on improving the reliability, flexibility and efficiency of temperature control devices.

Previously bi-metallic coils were used in thermostats. These coils, however, are subject to metal fatigue which results in drifting. Depending on location, drifting can cause a substantial energy loss in the range of 20 to 30 percent.

A major advancement in the thermostat field was the introduction of mercury switches. Such switches are set at the factory for predetermined operation. These switches serve to "switch on" the system at a specific temperature and "switch off" the system at another specific temperature. Although mercury switches do not suffer from drifting, they have generally not been readily adjustable. Accordingly, a number of the switches are usually required to achieve any degree of adjustability for temperature control.

SUMMARY OF THE INVENTION

The present invention relates to an adjustable temperature sensor apparatus. The apparatus includes a tube having a well section containing mercury and an elongate capillary section. A stem is disposed at the bottom of the well section. Mechanical means are employed to vertically move the stem in the well to displace mercury in the well into the capillary and vice versa. A first electrical set point contacts the mercury in the well. A second electrical set point is positioned at a predetermined length in the capillary.

The mercury in the well and capillary rises and falls according to the ambient temperature. As ambient temperature increases, the mercury rises in the capillary; as ambient temperature decreases, the mercury falls in the capillary. The first electrical connector which contacts the mercury in the well is variable and adjustable. The second electrical connector which contacts the mercury as it moves up the capillary is fixed. As the stem is mechanically moved both upwards and downwards in the well, mercury is displaced so as to act as a variable set point. The length of mercury displacement can be controlled and calibrated to correspond to a desired temperature. If, for example, screw means are used to displace mercury, then the degree of rotation of the screw means can be correlated to correspond to a desired temperature set point. Alternately, magnetic means can be used to displace mercury. A magnet surrounding the tube can be utilized to move a pin which is disposed within the well.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is an elevational view of a temperature sensor case with a cut-away section showing the adjustable temperature sensor control device of this invention.

FIG. 2 is an elevational view taken along line 2—2 of FIG. 1 and which shows the adjustable temperature sensor control device of this invention in detail.

FIG. 3 is a plan view taken along line 3—3 of FIG. 1 and which shows a top view of the adjusting knob of the sensor device of this invention in detail.

FIG. 4 is a plan view taken along line 4—4 of FIG. 1 and also which shows a top view of the adjusting knob of the sensor device of the present invention in detail.

DETAILED DESCRIPTION OF THE INVENTION

Referring to the drawings, wherein like numerals indicate like elements, there is shown in FIG. 1 a temperature sensor case 10 housing the adjustable temperature sensor control apparatus 12 of the present invention. The adjustable temperature sensor control apparatus 12 includes a cylindrical sensor tube 14 which can be fabricated from any convenient material such as glass. Inside the sensor tube 14 is a generally centrally positioned cylindrical capillary 16 which terminates at its bottom portion in a well 18. The well 18 serves to contain a suitable fluid responsive to temperature changes such as mercury.

An outer sleeve 20 is located at the bottom end of the sensor tube 14. The outer sleeve 20 can be fabricated from any suitable metal or alloy such as stainless steel. Mercury in the well 18 makes electrical contact with the outer sleeve 20. Clip contact 22 is in electrical contact with outer sleeve 20 and also serves to hold the adjustable temperature sensor control apparatus 12 in place within the temperature sensor case 10. Clip contact wire 24 electrically connects clip contact 22 with solid state electronic circuitry (not shown).

Solder contact 26 is positioned at a set predetermined length along sensor tube 14. Solder contact 26 is also electrically connected to the solid state electronic circuitry. Solder contact 26 has an electrical connecting wire (not shown) fabricated from a suitable metal such as platinum having a diameter in the range of 0.004 inch. This connecting wire pierces the sensor tube 14 and serves to connect solder contact 26 with mercury that rises in the capillary 16. The solder contact 26 forms a ring around the outside the sensor tube 14 and is generally fabricated from a band of phosphorous bronze which is then covered with solder.

At the bottom end of outer sleeve 20 is an adjusting knob 28. The adjusting knob 28 has a calibration band 30 having a greater circumference than the adjusting knob 28.

Referring now to FIG. 2 which shows the temperature sensor 12 in greater detail, the outer sleeve 20 is firmly connected to the temperature sensor by means of a band of sealant 32, such as an epoxy sealant. A stem 34 is internally disposed through outer sleeve 20 and contacts at one end thereof well 18 at the other end thereof adjusting knob 28. Stem 34 has a smooth finish which serves to limit mercury leakage. The adjusting knob 28 is mechanically connected to stem 34 by set screws 36. Stem 34 has screw threads on its outer surface which mesh with screw threads on the inner surface of bushing lock 38. The outer surface of bushing lock 38 has screw threads itself which mesh with screw threads on the internal surface of outer sleeve 20. Set pin 40 serves to mechanically connect bushing lock 38 with stem 34 such that when the adjusting knob 28 is rotated, the stem 34 screws within the bushing lock 38. An O-ring 42, fabricated from a resilient material such as rubber, is interposed between the top of the bushing lock 38 and an internal abutment 44 of outer sleeve 20. When the bushing lock 38 moves upwards within the inner surface of the outer sleeve 20, the O-ring 42 is compressed to create a mercury tight seal to prevent leakage around stem 34.

The present invention may be embodied in other specific forms without departing from the spirit or essential attributes thereof and, accordingly, reference should be made to the appended claims, rather than to the foregoing specification, as indicating the scope of the invention.

I claim:

1. An adjustable temperature sensor control apparatus comprising a tube sealed from the atmosphere, said tube having a well section containing mercury and an elongate capillary section disposed above said well, a first electrical connector in contact with said mercury in said well, said first electrical connector having a set point associated therewith, a second electrical connector positioned at a fixed location in said capillary and having a fixed set point associated therewith, a stem disposed adjacent the bottom of said well, said stem in direct contact with said mercury and mechanical means to vertically move said stem in said well to displace said mercury in said well into and up through said capillary and vice versa so as to vary the set point associated with said first electrical connector, said displacement of mercury controlled and calibrated to correspond to a desired temperature setting.

2. The apparatus of claim 1 wherein said mechanical means includes screw means.

3. The apparatus of claim 1 wherein said mechanical means includes magnetic means.

4. The apparatus of claim 2 wherein said displacement of mercury is controlled by a calibrated adjustable knob.

5. The apparatus of claim 1 wherein said tube is constructed from glass.

6. The apparatus of claim 1 wherein said second electrical connector point comprises a platinum electrode.

7. The apparatus of claim 1 wherein sealing means is disposed around said stem to prevent leakage of mercury from said well past said stem.

* * * * *